US010993548B2

(12) United States Patent
Moriarty

(10) Patent No.: US 10,993,548 B2
(45) Date of Patent: May 4, 2021

(54) ENCLOSED SEATING ASSEMBLY

(71) Applicant: Anne Moriarty, Louisville, CO (US)

(72) Inventor: Anne Moriarty, Louisville, CO (US)

( * ) Notice: Subject to any disclaimer, the term of this patent is extended or adjusted under 35 U.S.C. 154(b) by 0 days.

(21) Appl. No.: 16/574,768

(22) Filed: Sep. 18, 2019

(65) Prior Publication Data

US 2020/0093280 A1 Mar. 26, 2020

Related U.S. Application Data

(60) Provisional application No. 62/735,040, filed on Sep. 22, 2018.

(51) Int. Cl.

| | |
|---|---|
| ***A47C 12/00*** | (2006.01) |
| ***A47B 3/00*** | (2006.01) |
| ***A47C 1/02*** | (2006.01) |
| ***A47D 1/02*** | (2006.01) |
| ***A47D 1/00*** | (2006.01) |
| ***A47D 15/00*** | (2006.01) |

(52) U.S. Cl.

CPC ..... *A47D 1/023* (2017.05); *A47D 1/002* (2013.01); *A47D 1/0085* (2017.05); *A47D 15/00* (2013.01); *A47D 15/006* (2013.01)

(58) Field of Classification Search

CPC .. A47C 4/286; A47C 4/04; A47C 4/03; A47C 4/20; A47C 4/283; A47C 4/00; A47C 12/02; A47C 4/045; A47C 12/00; A47C 4/021; A47D 11/00; A47D 11/002

USPC ..... 297/16.1

See application file for complete search history.

(56) References Cited

U.S. PATENT DOCUMENTS

| | | | | | |
|---|---|---|---|---|---|
| 183,924 | A | * | 10/1876 | Harrison | A47C 12/02 182/33.3 |
| 703,690 | A | * | 7/1902 | Young | A61G 5/08 297/44 |
| 2,546,811 | A | * | 3/1951 | Anderson | A47C 4/024 297/331 |
| 2,580,935 | A | * | 1/1952 | Lovelace | A47D 1/103 297/152 |
| 2,631,699 | A | * | 3/1953 | Schultz | A47C 4/52 190/8 |
| D181,793 | S | * | 12/1957 | Hansen | D25/65 |
| 3,530,954 | A | * | 9/1970 | Schmidt | A47C 12/02 182/33 |
| 3,570,418 | A | * | 3/1971 | Gooding | A47D 11/00 108/12 |

(Continued)

*Primary Examiner* — Shin H Kim

(74) *Attorney, Agent, or Firm* — Trenner Law Firm, LLC; Mark D. Trenner

(57) ABSTRACT

An example enclosed seating assembly includes a foldable chair enclosure. The example enclosed seating assembly also includes a perch seat for a user to rest against but not fully sit on in the foldable chair enclosure. At least one adjustable height foot platform is provided at the base of the foldable chair enclosure. At least one sensory module provides varied input for the user. The example enclosed seating assembly includes an anti-tip structure on the base of the foldable chair enclosure configured to reduce or altogether prevent tipping. The example enclosed seating assembly includes built in storage for the at least one sensory module. In an example, the enclosed seating assembly includes a door on a sidewall of the chair enclosure for the user to enter and exit the chair enclosure. In another example, the enclosed seating assembly includes a ramp.

20 Claims, 11 Drawing Sheets

(56) References Cited

U.S. PATENT DOCUMENTS 3,592,506 A * 7/1971 Breslow ..... A47D 1/04 297/188.1
3,603,656 A * 9/1971 Ferman ..... A47C 4/021 312/195
3,650,351 A * 3/1972 Schmidt ..... A47C 12/02 182/33.3
3,788,700 A * 1/1974 Wartes ..... A47B 85/00 297/440.13
D242,423 S * 11/1976 Culligan ..... D34/1
4,205,876 A * 6/1980 Cetina ..... A47D 1/00 297/118
4,593,950 A * 6/1986 Infanti ..... A47C 3/029 297/130
4,630,861 A * 12/1986 Henschel ..... A47C 4/08 108/124
4,645,261 A * 2/1987 Bourne ..... A47D 11/002 297/118
4,763,580 A * 8/1988 Garland ..... A47D 1/004 108/91
4,926,759 A * 5/1990 Vitsky ..... A47B 47/06 108/180
5,094,505 A * 3/1992 Nichols ..... A47C 12/02 182/33.3
D354,210 S * 1/1995 Dickinson ..... D25/63
5,634,687 A * 6/1997 Gamble ..... A47D 1/004 297/338
5,967,255 A * 10/1999 Young ..... A47B 5/06 182/91
6,568,506 B1 * 5/2003 Donnalley ..... A47C 12/02 108/129
6,634,712 B2 * 10/2003 Gamble ..... A47D 1/004 297/338
6,883,878 B2 * 4/2005 Gorelick ..... A47B 83/00 297/17
7,134,728 B1 * 11/2006 Buhrman ..... A47C 3/34 297/440.14
D568,942 S * 5/2008 Gauselmann ..... D21/325
7,828,117 B2 * 11/2010 Cole ..... A47C 12/02 182/33
7,905,184 B2 * 3/2011 Eveleth ..... A47B 3/08 108/115
D668,070 S * 10/2012 Kim ..... D6/353
8,621,739 B1 * 1/2014 Elliot ..... A47C 4/021 29/428
8,661,991 B2 * 3/2014 Eveleth ..... A47B 3/08 108/115
8,701,830 B2 * 4/2014 Merey ..... E06C 1/383 182/152
9,538,887 B2 * 1/2017 Ito ..... A47K 11/00
D798,609 S * 10/2017 Henschel ..... D6/330
D834,843 S * 12/2018 Riekstina-Snore ..... D6/350
10,306,996 B1 * 6/2019 Sima ..... A47D 11/00
10,694,859 B1 * 6/2020 Wickland ..... A47C 16/02
2004/0251717 A1 * 12/2004 Tamura ..... A47C 4/52 297/17
2006/0061191 A1 * 3/2006 Pelletier ..... A47C 7/68 297/440.12
2007/0102986 A1 * 5/2007 Buhrman ..... A47C 4/021 297/440.13
2011/0017547 A1 * 1/2011 Lee ..... E06C 1/005 182/23
2012/0080910 A1 * 4/2012 Davis ..... A47C 4/021 297/118
2014/0131138 A1 * 5/2014 Simpson ..... A47C 12/00 182/223
2015/0223606 A1 * 8/2015 Gerstle ..... A47D 1/00 297/452.1
2017/0127838 A1 * 5/2017 Thuma ..... A47C 5/12
2019/0174918 A1 * 6/2019 King ..... A47B 85/04
2019/0208921 A1 * 7/2019 Hjelmeland ..... A47C 7/50
2020/0300038 A1 * 9/2020 Pinnock ..... E04F 11/062

* cited by examiner

ENCLOSED SEATING ASSEMBLY

CROSS REFERENCE TO RELATED APPLICATIONS

This application claims the priority benefit of U.S. Provisional Patent Application No. 62/735,040 filed Sep. 22, 2018 for "An Enclosed Seating Assembly," hereby incorporated by reference in its entirety as though fully set forth herein.

BACKGROUND

Mealtime can be a frustrating, chaotic, and an exhausting time for parents. Some children or teens have difficulty resisting the urge to leave their seat during a meal or activity. When children or teens leave their seat, they may disrupt others or fail to complete the meal or activity. A need exists for an apparatus that helps active children or teens feel comfortable sitting for dinner or an activity. Many families hope to have an improved, positive experience at mealtime.

DETAILED DESCRIPTION

Figure 1:
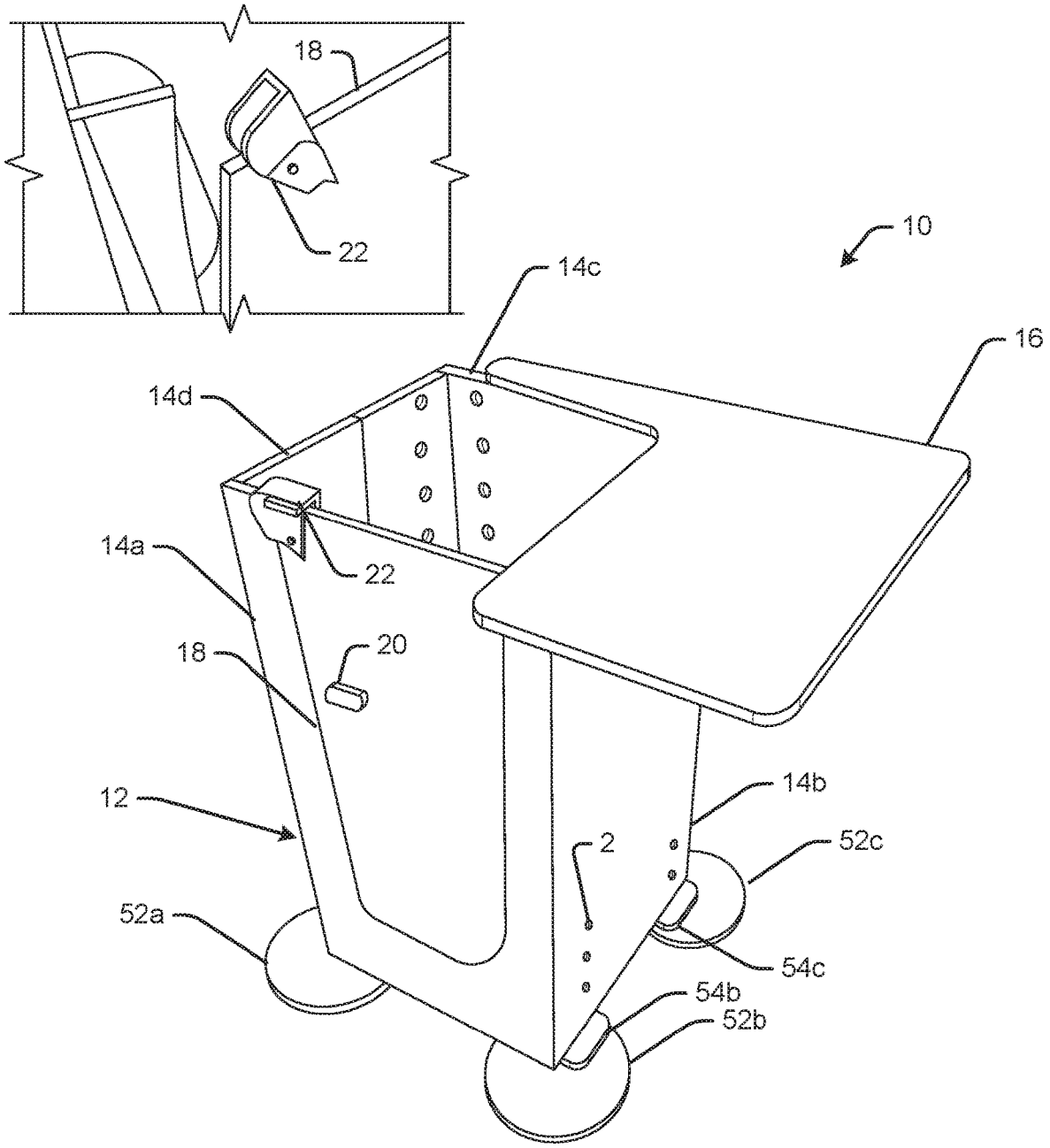
FIG. 1 is a perspective view of an example enclosed seating assembly.

An example enclosed seating assembly is disclosed. The example enclosed seating assembly may be implemented for energetic children, pre-teens, teens or special needs adults, by way of illustration, however not by way of limitation as to end-user.

In an example, the enclosed seating assembly includes a foldable chair enclosure having at least four sidewalls. The example enclosed seating assembly also includes an adjustable height perch seat for a user to rest against but not fully sit on in the foldable chair enclosure, the perch seat removable from the foldable chair enclosure. At least one adjustable height foot plate or platform is provided at the base of the foldable chair enclosure. The example enclosed seating assembly also includes an anti-tip structure on the base of the foldable chair enclosure configured to reduce or altogether prevent tipping.

In an example, the enclosed seating assembly has a detachable tray. The example enclosed seating assembly may also include a door on a sidewall of the chair enclosure for the user to enter and exit the chair enclosure.

In another example, the enclosed seating assembly has a ramp formed from a sidewall of the chair enclosure. The ramp enables the user to enter and exit the chair enclosure.

The example enclosed seating assembly has at least one sensory module which provides varied input for the user. By way of illustration, the example enclosed seating assembly may include tactile and balance items which may be placed on top of the foot platform, which may give a child sufficient sensory input to enable the child to be more focused on the task before them. In an example, the tactile or balance items may be detachably coupled to the foot platform such as by hook and loop or VELCRO™ fasteners. Use of the example enclosed seating assembly may help create a more peaceful mealtime or activity time for all, while honoring the child's neurological and physical needs to have more sensory input.

The term "foot pad" as used herein refers to a pad, item or object that provides sensory input to a person. A user may stand on a foot pad with the user's feet, sit on the foot pad, or rest a different body part on the foot pad. The foot pad may be separate from or combined as part of the foot platform.

The example enclosed seating assembly may be used by families, child care centers, day care homes, child occupational and physical therapists, inclusive schools, and teachers of children with special needs, programs for children with autism, programs for profoundly gifted children.

The example enclosed seating assembly may include a square wooden tower, formed from a chair enclosure assembly having a first wall, a second wall, a third wall, and a door, attached to a non-tip base with non-marring rubber feet. The example enclosed seating assembly may accommodate children of varied heights through a height-adjustable interior footplate and a height-adjustable shallow shelf seat or "perch" seat for a user to rest against, but not a full seat on which to actually sit down upon. The back panel may hinge open or be hingedly openable to allow changing the height of the footplate, adding sensory items and allowing the child to step in or crawl in independently. The example enclosed seating assembly may be designed to fit just under a standard dining table.

During example use, a facilitator may position the example enclosed seating assembly at the desired spot at the table. Then the facilitator may open the latch and swing open the back panel. The facilitator, who may be an adult, may position the footplate at the right height for the child, and may help the child choose a sensory or balance item to place on top of the footplate. Holders for the footplate may be installed for holding the footplate. A user may insert the footplate into the holders and depending on the height of the holders which are selected for use, the height of the footplate may be adjusted.

The child may step into the example enclosed seating assembly, crawl into the example enclosed seating assembly, or be placed into the example enclosed seating assembly. In an example, the child may stand on the foot platform. A foot platform may be vertically-adjusted before the child stands on the foot platform.

In an example, the adult adjusts the seat height as needed, then closes the back panel, which may also be called a door, and secures the latch assembly. A magnetic component or button type latch having a button may be included in the latch assembly.

In an example, after the back panel or door has been latched, or closed the child may be free to move their feet upon the sensory footplate, while their arms move freely above the top edges of the tower, as they eat or do an activity at the table. In an example, a second foot platform or foot pad may have sensory ridges, bumps or contours; or the foot pad or second foot platform may be made from a material that provides sensory feedback to a user, such as a rubber, foam, or plastic, or wood, or metal.

In an example, a hook, cubby, or other area coupled to the example enclosed seating assembly may be configured for holding a child's shoes so that a child may use the example enclosed seating assembly without shoes while having a convenient location to place the shoes. If the child tires of standing, they can lean back or sit on the shelf seat, which may only cover between 2% and 10%, or between 10% and 20%, or between 20% and 30%, or between 30% and 40% of the length of the second foot platform 220.

In an example the second foot platform extends substantially to the walls of the chair enclosure assembly when the second foot platform has been installed. Referring to the situation when a child stands on the second foot platform and is allowed to move about the surface of the second foot platform, then the additional sensory input from the child's muscles, whether coming while the child is moving about the second foot platform or perching or sitting on the shelf seat, may allow the child's brain to better organize and attend to the meal or task before them. When finished, the adult may unlatch the back panel and the child then steps out or exits the interior of the booth chair assembly. In some embodiments, the latching assembly may have features making it difficult for a child to latch or unlatch the latch assembly. The sensory items which are not in use may be stored in net pockets, referred to as netting, attached to an outer surface of the booth chair assembly.

The example enclosed seating assembly may be used during mealtimes, while a child performs tasks at the table, such as artwork, learning games, etc. Some embodiments may include such features as a drop-in seat for younger children, a tray, a larger version for older children, an additional sensory accessory pack, a plastic shield and the like.

Before continuing, it is noted that as used herein, the terms "includes" and "including" mean, but are not limited to, "includes" or "including" and "includes at least" or "including at least." The term "based on" means "based on" and "based at least in part on." The term "coupled" means to be in direct or indirect contact with another object. In an example, two or more objects that are "coupled" may be affixed by some type of physical or nonphysical means such as glue, screw, nail, mating connections, soldering, which also includes being detachably affixed which means that a relatively temporary means has been used to affix the two or more objects. An example of physical means to couple is by magnetic forces. Detachably coupled refers to temporary coupling such as a ball bearing to a surface where the physical contact between the two objects can be easily removed by gravity or other weak force. As mentioned above, indirect coupling includes Object A being coupled to Object B and Object C being coupled to Object B would mean that Object A is coupled to Object C even if Object A is not physically contacting Object C. Additional elements may be coupled to each other in this manner.

Figure 2:
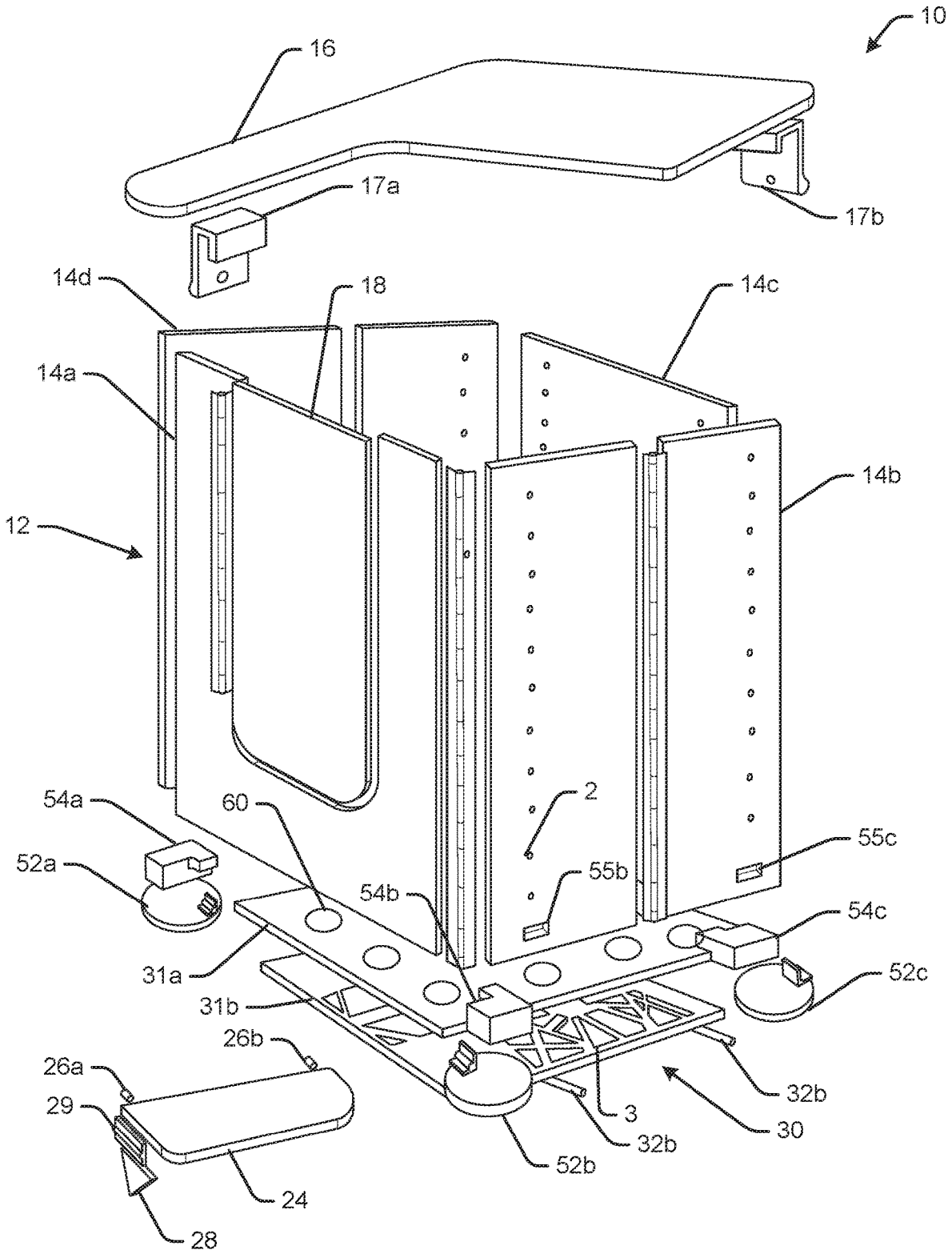
FIG. 2 is an exploded component view of the example enclosed seating assembly shown in FIG. 1.
Figure 3:
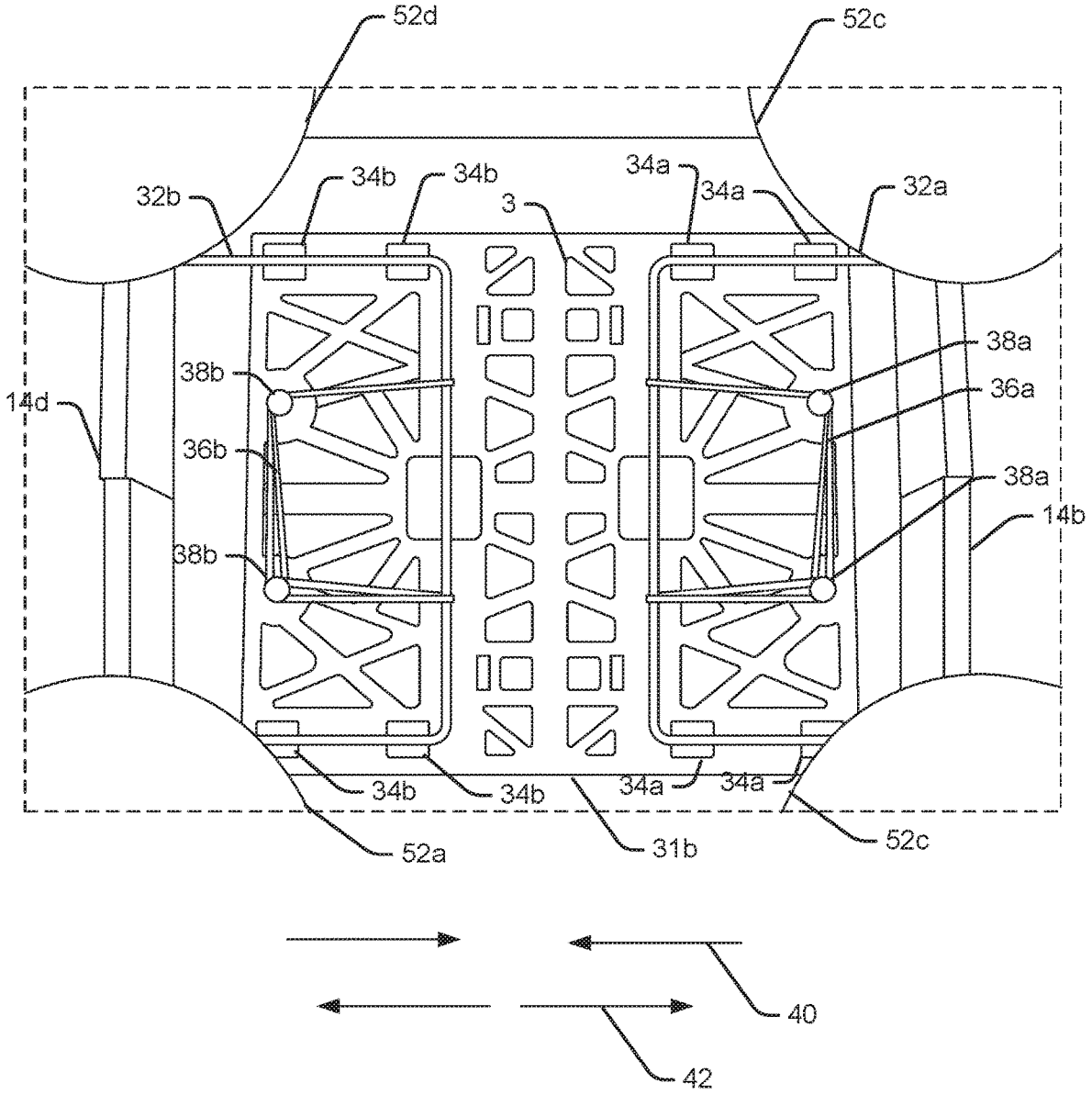
FIG. 3 is a bottom view of the example enclosed seating assembly shown in FIG. 1.

FIG. 1 is a perspective view of an example enclosed seating assembly 10. FIG. 2 is an exploded component view of the example enclosed seating assembly 10 shown in FIG. 1. It is noted that in FIG. 2 the table is shown, for purposes of illustration, "flipped" to face in another direction to that shown in FIG. 1 to indicate that the table can be mounted in various configurations. Likewise, the door is shown, for purposes of illustration, hinged on the opposite side to that shown in FIG. 1 to indicate that the door can be hinged to either side and/or to any sidewall. The table may be configured with components oriented in any desirable position. FIG. 3 is a bottom view of the example enclosed seating assembly 10 shown in FIG. 1.

An example of the enclosed seating assembly 10 includes a chair enclosure 12 having sidewalls 14*a-d* (e.g., forming a cube). It is noted that the chair enclosure 12 may include a different number of sidewalls than that shown in FIG. 1, and may form any desired shape. The chair enclosure and related components (e.g., seat, table, legs, sensory modules, etc.) may be of any desired color scheme.

A removable table 16 may be provided for mounting on one or more of the sidewalls 14*a-d*, e.g., by brackets 17*a* and 17*b* (FIG. 2). One or more door 18 may be provided to facilitate entry and exit from the chair enclosure 12. In an example, the door 18 is hinged to the sidewall 14*a*, and may include a handle 20 and latch 21 to hold the door 18 closed.

The example enclosed seating assembly 10 also includes a seat 24 (see, e.g., FIG. 2). In an example, the seat is a "perch" seat 24. A "perch" seat, as the term is used herein, means that the seat is configured large enough for a user to rest against in a somewhat seated position to take some weight off his or her feet, but not so large that the user can fully sit on the seat. In other words, the user is considered to be "perched" on the seat when resting against it, rather than fully in a seated position sitting on the seat.

In an example, the perch seat 24 may be attached or connected on one of the sidewalls (e.g., sidewall 14*d*) inside the chair enclosure 12 by pegs 26*a-b*. The perch seat 24 may be further supported perpendicular to the sidewall 14*d* by extending hinged supports (support 28 and associated hinge 29 for one of the sides of the seat 24 is visible in FIG. 2; more than one support may be provided by the seat, e.g., one on each side of the seat). The supports 28 can be folded down on the hinge 29 to provide a brace for the perch seat 24.

The perch seat 24 may be height adjustable. In an example, the perch seat 24 is height adjustable by attaching or resting it on the pins 26*a*, 26*b* inserted into peg holes 2 in one or more of the sidewalls 14*a-d* at the desired height. That is, the pins 26*a*, 26*b* can be inserted into peg holes 2 corresponding to the desired height of the perch seat 24.

The example enclosed seating assembly 10 also includes at least one foot platform 30 at the base of the chair enclosure 12. The foot platform 30 raises the user off of the ground and provides a contained space within the chair enclosure 12. In the example shown in FIGS. 1-3, the foot platform 30 includes an upper solid layer 31*a* where the user stands (e.g., for receiving a sensory module), and a lower layer 31*b* for height adjustment and support. The lower layer 31*b* may include openings 3 formed therethrough. The openings 3 enable a skeletal structure which provides support for the upper layer 31*a*, while reducing the weight of the foot platform 30.

In an example, the foot platform 30 is height adjustable. For example, the platform 30 may be adjusted in height by support bars 32*a* and 32*b*. Support bars 32*a* and 32*b* are shown in the example in FIG. 3 as being generally U-shaped (although other shapes are contemplated). The support bars 32*a* and 32*b* may be inserted into and slidably attached in a plurality of anchors 34*a* and 34*b* (respectively for each support bar 32*a* and 32*b*). The support bars 32*a* and 32*b* may be biased in an outward position by a spring band 36*a* and 36*b*, respectively, wrapped around knobs 38*a* and 38*b*.

In use, the support bars 32*a* and 32*b* can be squeezed or pulled toward each other in the direction of arrows 40 in FIG. 3 against the tension of the spring bands 36*a* and 36*b* so that the lower surface 21*b* of the foot platform 20 can be positioned at the desired height within the chair enclosure 12. Once at the desired height, the support bars 32*a* and 32*b* may be released and return under tension of the spring bands 36*a* and 36*b* (in the direction of arrows 42 in FIG. 3) so that the support bars 32*a* and 32*b* extend outward into the openings or peg holes 2 in one or more of the sidewalls 14*a-d* of the chair enclosure 12. As such the foot platform 30 can be positioned at any desired height (e.g., by selecting the corresponding peg holes 2 for that height). The upper surface 31*a* of the foot platform 30 may be added on top of the lower surface 31*b* to complete the foot platform 30 in this example.

The example enclosed seating assembly 10 may be provided with at least one sensory module 60 to provide varied input for the user. "Sensory modules" are tangible items that are configured to provide the user with various tactical input or feedback for the user. By way of illustration, the sensory module 60 may include a patterned floor to include on the foot platform 30. The pattern may be provided as part of the foot platform 30, or provided on top of the foot platform 30. For example, the sensory module 60 is shown as raised portions or "bumps" formed on the platform 30 in FIG. 2.

It is noted that any type of sensory module, any combination of sensory modules, and any number of sensory modules may be provided. For example, the sensory module may be provided as a cooling mat, a heating mat, a soft surface, a ribbed surface, a textured surface, etc. In addition, the sensory module may be provided in different areas (e.g., on the door, on the table, on one or more of the sidewalls). Other non-limiting examples of sensory modules are discussed below with reference to other examples of the enclosed seating assembly disclosed herein.

In an example, the enclosed seating assembly 10 may include a storage for the sensory module. For example, the sensory module may be provided in a pocket or otherwise attached to the chair enclosure 12. By way of illustration, the sensory modules may be stored in a large plastic "pocket file" attached to side of chair enclosure 12. In another example, a separate bucket or storage area may be provided for the sensory module(s) when not in use.

The example enclosed seating assembly 10 also includes an anti-tip feature or stable base 50 to reduce or altogether prevent tipping. In the example shown in FIG. 1, the stable base 50 may include large diameter circular feet 52*a-d* on each corner of the chair enclosure 12.

Figure 4A:
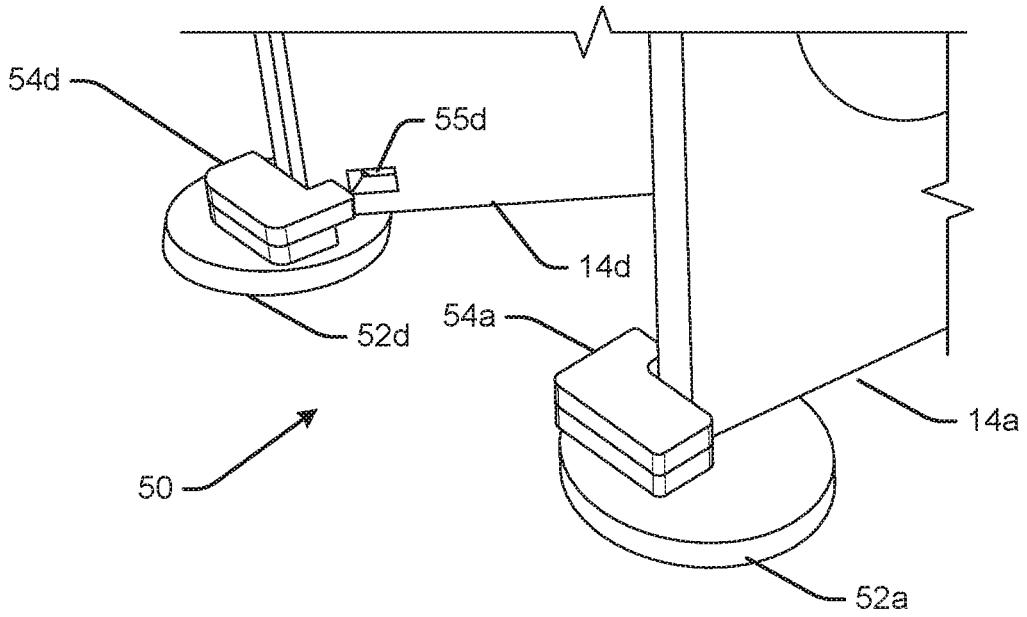
FIGS. 4A and 4B are close up views of feet of the example enclosed seating assembly shown in FIG. 1.
Figure 4B:
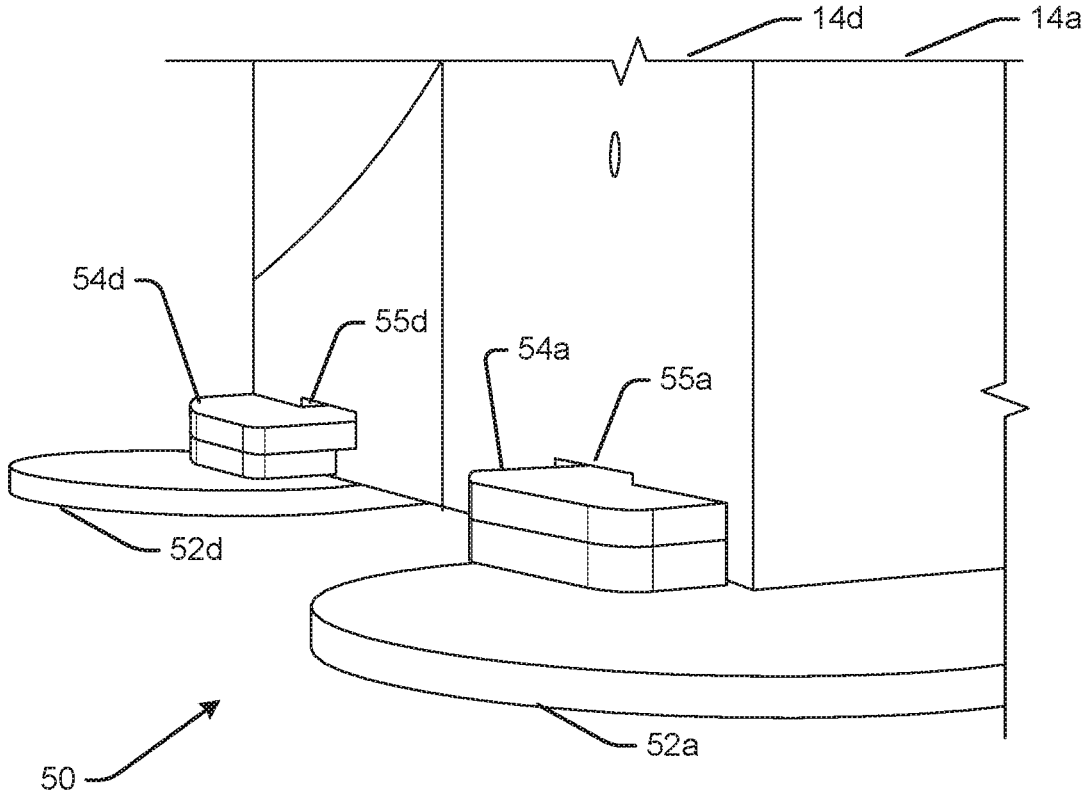

FIGS. 4A and 4B are close up views of feet 52*a-d* of the example enclosed seating assembly 10 shown in FIG. 1. In an example, the feet includes locking blocks 54*a-d* that snap fit into slots 55*a-d* formed in the sidewalls (e.g., sidewalls 14*b* and 14*d*) to aid in securing the feet 52*a-d* to the enclosure 12. This aspect provides a secure foundation and an "anti-tipping" feature for the enclosed seating assembly 10 to reduce or altogether prevent tipping of the enclosure 12 during normal use.

Figure 5A:
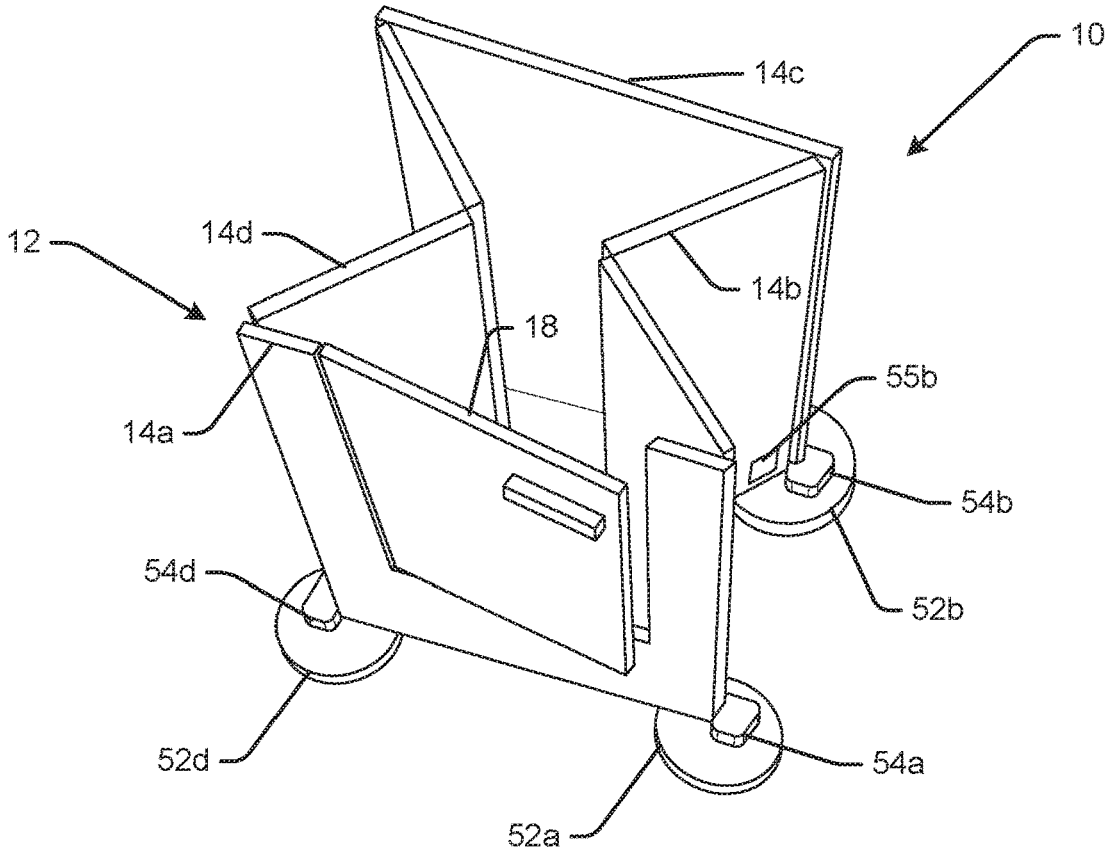
FIGS. 5A and 5B illustrate folding of the example enclosed seating assembly shown in FIG. 1.
Figure 5B:
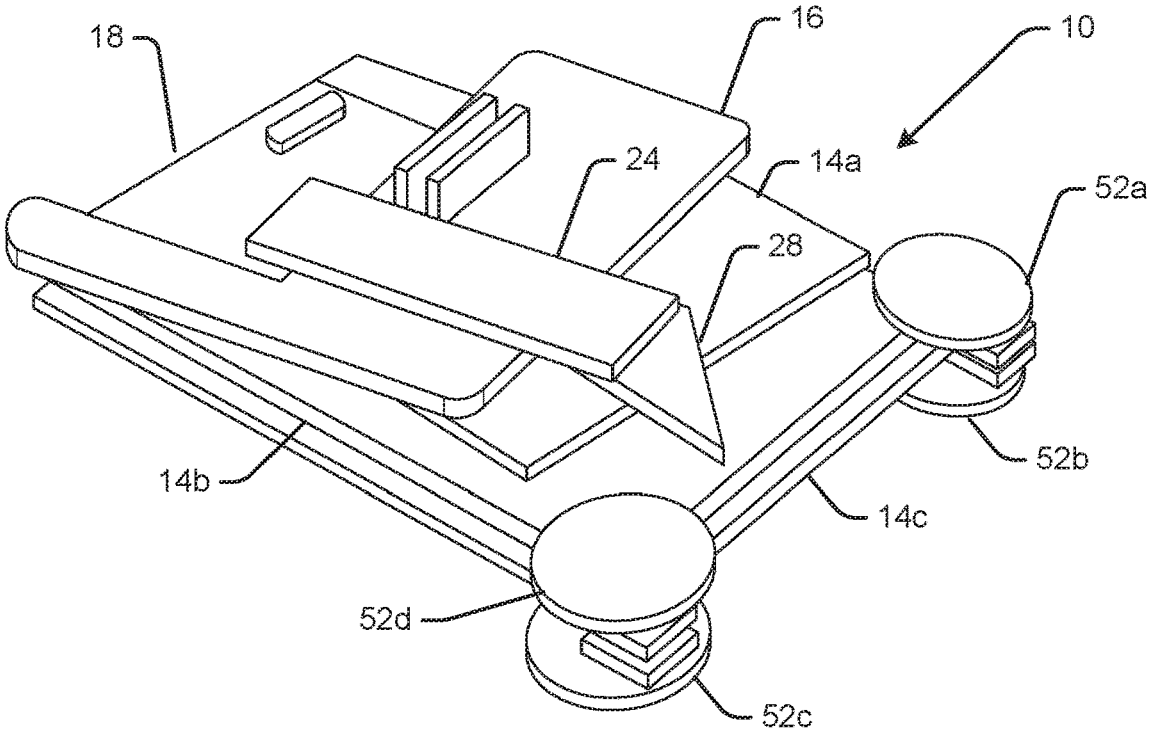

The enclosed seating assembly 10 is collapsible and foldable for convenient storage and/or shipping. FIGS. 5A and 5B illustrate folding of the example enclosed seating assembly 10 shown in FIG. 1. In an example, the enclosure 12 is detached from the tray 16 and the foot platform 30. The seat 24 is removed from within the enclosure 12. At least two of the sidewalls 14*b* and 14*d* are hinged to fold in half, as shown in FIG. 5A. FIG. 5B shows the enclosed seating assembly 10 in a fully folded configuration. The process can be reversed for readily assembling the enclosed seating assembly 10.

Before continuing, it should be noted that the examples described herein are provided for purposes of illustration, and are not intended to be limiting. Other devices and/or device configurations may be utilized to carry out the operations described herein. The operations shown and described herein are provided to illustrate example implementations. The operations are not limited to the ordering shown. Still other operations may also be implemented.

Figure 6:
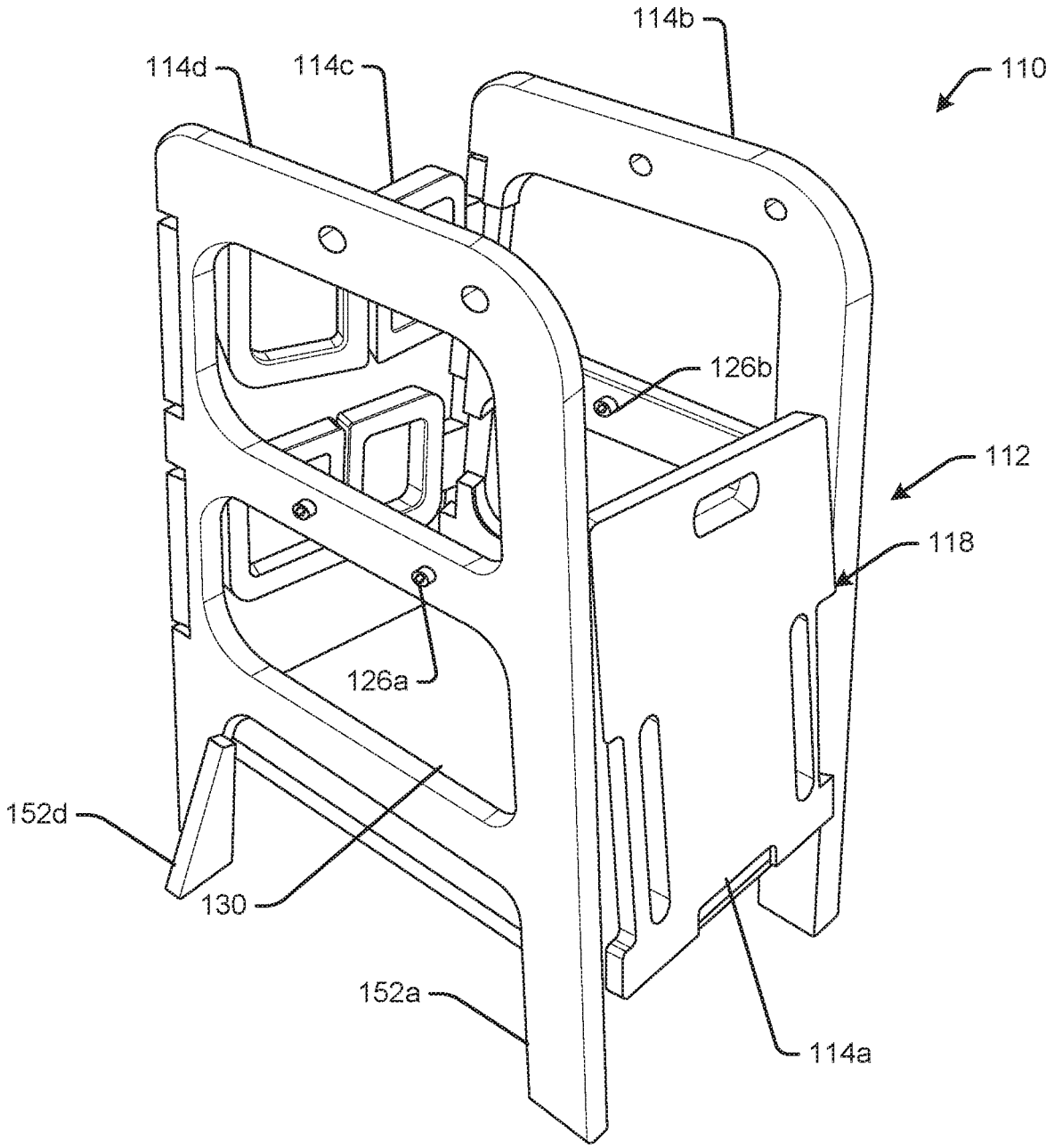
FIGS. 6 and 7 are perspective views of another example enclosed seating assembly.
Figure 7:
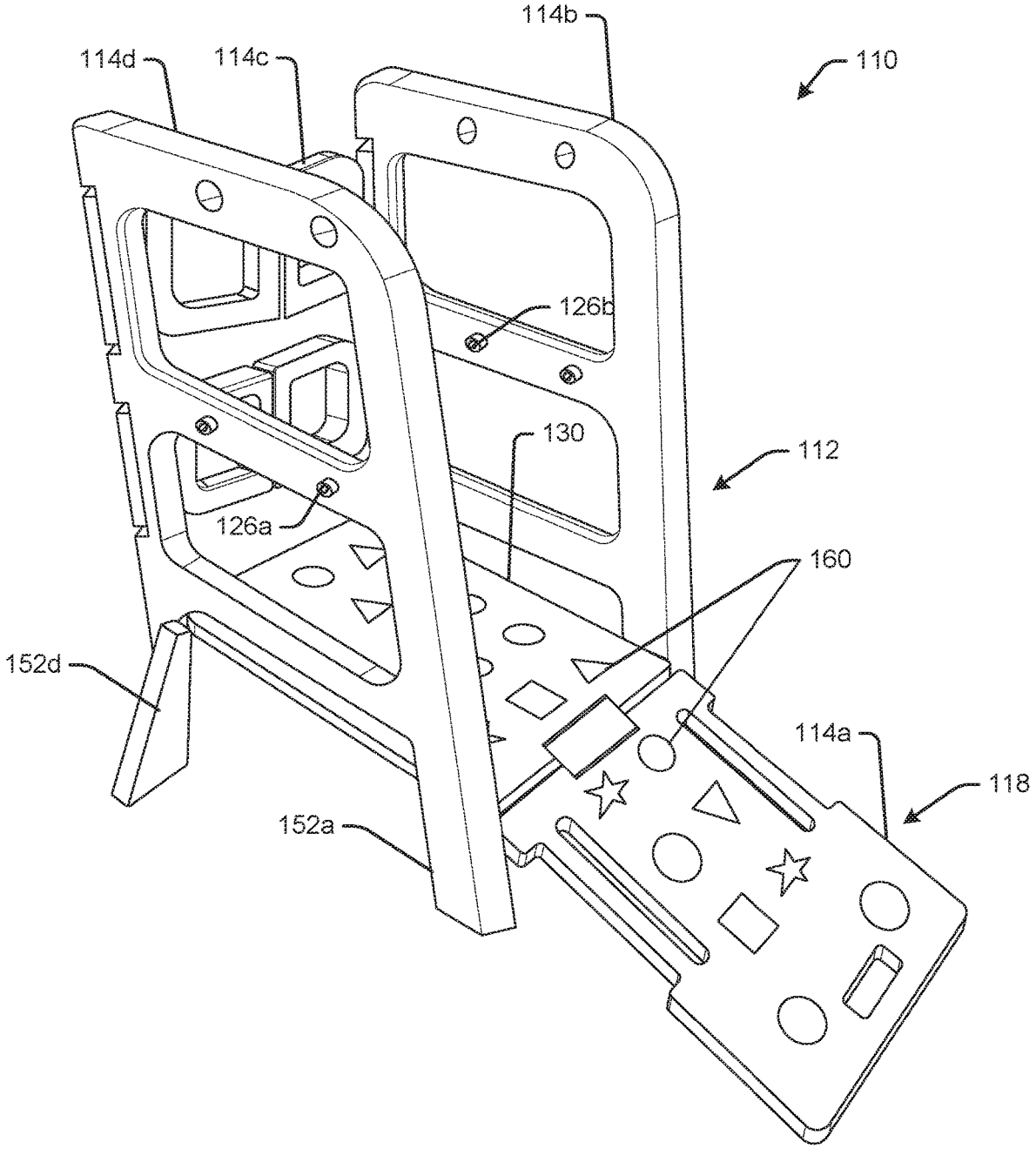

FIGS. 6 and 7 are perspective views of another example enclosed seating assembly 110. It is noted that like reference numbers in the 100-series are used herein to refer to like components. The description of like components is not described again for this example.

An example of the enclosed seating assembly 110 includes a chair enclosure 112 having sidewalls 114*a-d*. The chair enclosure and related components (e.g., seat, table, legs, sensory modules, etc.) may be of any desired color scheme.

In this example, one or more door 118 may be provided by one of the sidewalls folding down into a ramp to facilitate entry and exit from the chair enclosure 112. In an example, the ramp 118 is hinged sidewall 114*a*.

In an example, the edge of the sidewall 114*a* may also serve as a perch seat. In another example, the enclosed seating assembly 110 may include a perch seat that can be mounted to one or more of the sidewalls 114*a-d* (e.g., with pegs or pins 126*a*, 126*b*). In another example, the enclosed seating assembly 110 may include no seat.

The example enclosed seating assembly 110 also includes at least one foot platform 130 at the base of the chair enclosure 112. The foot platform 130 raises the user off of the ground and provides a contained space within the chair enclosure 112.

The example enclosed seating assembly 110 may be provided with at least one sensory module 160 to provide varied input for the user. "Sensory modules" are tangible items that are configured to provide the user with various tactical input or feedback for the user. By way of illustration, the sensory module 160 may include a patterned floor to include on the foot platform 130. The pattern may be provided as part of the foot platform 130, or provided on top of the foot platform 130. Other sensory modules may be provided, and may be stored, for example in mesh bags which hang from metal pegs on the side walls.

The example enclosed seating assembly 110 also includes an anti-tip feature or stable base 150 to reduce or altogether prevent tipping. In the example shown in FIG. 7, the stable base 150 may include flared feet 152*a-d* on each corner of the chair enclosure 112.

Figure 8:
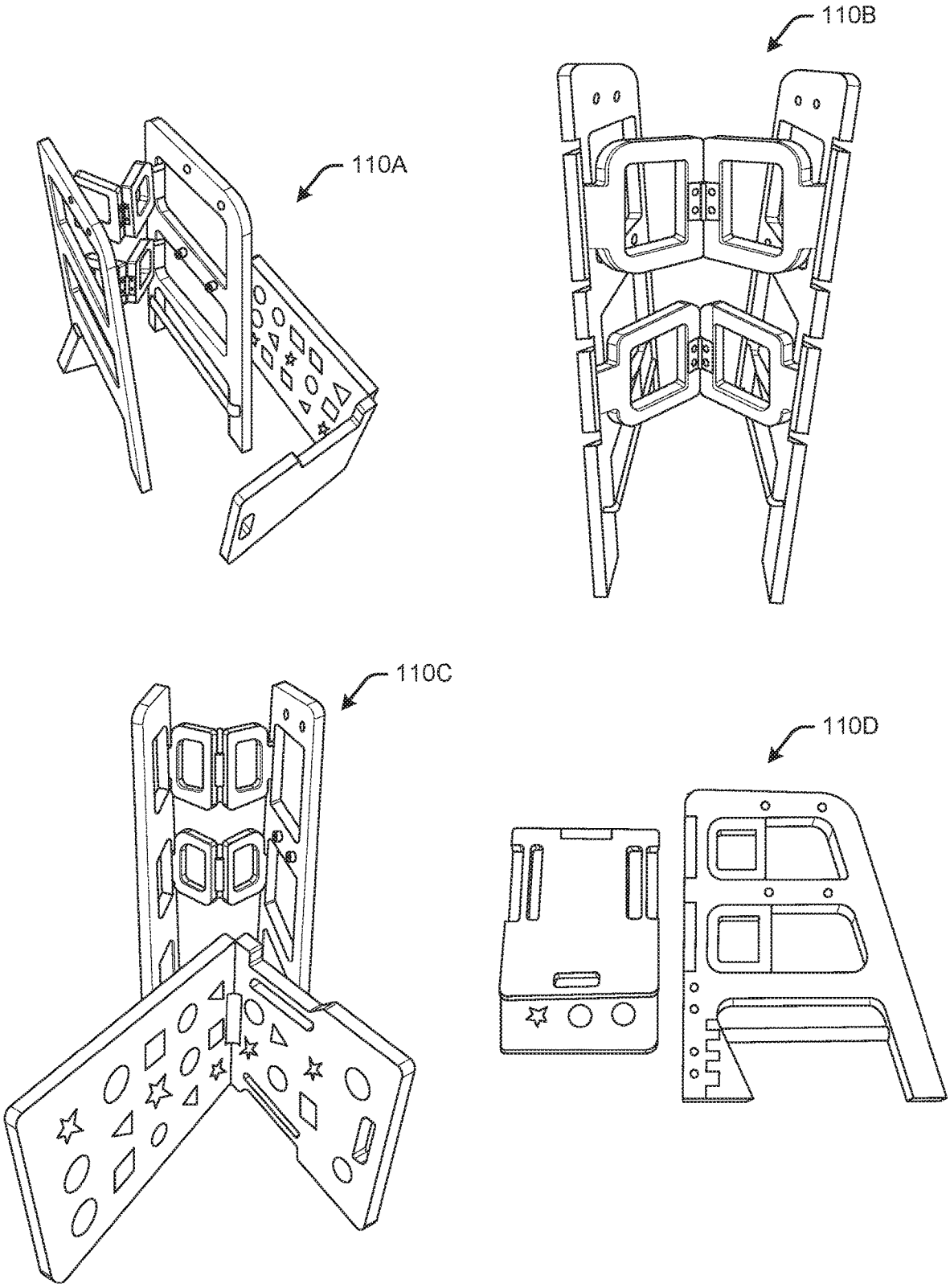
FIG. 8 illustrates folding of the example enclosed seating assembly shown in FIGS. 6 and 7.

The enclosed seating assembly 110 is collapsible and foldable for convenient storage and/or shipping. FIG. 8 illustrates folding of the example enclosed seating assembly 110 shown in FIGS. 6-7 (shown in various configurations 110A-110D). In an example, the enclosure 112 is detached from the foot platform 130. At least one of the sidewalls 114*c* is hinged to fold in half. The process can be reversed for readily assembling the enclosed seating assembly 110.

Figure 9A:
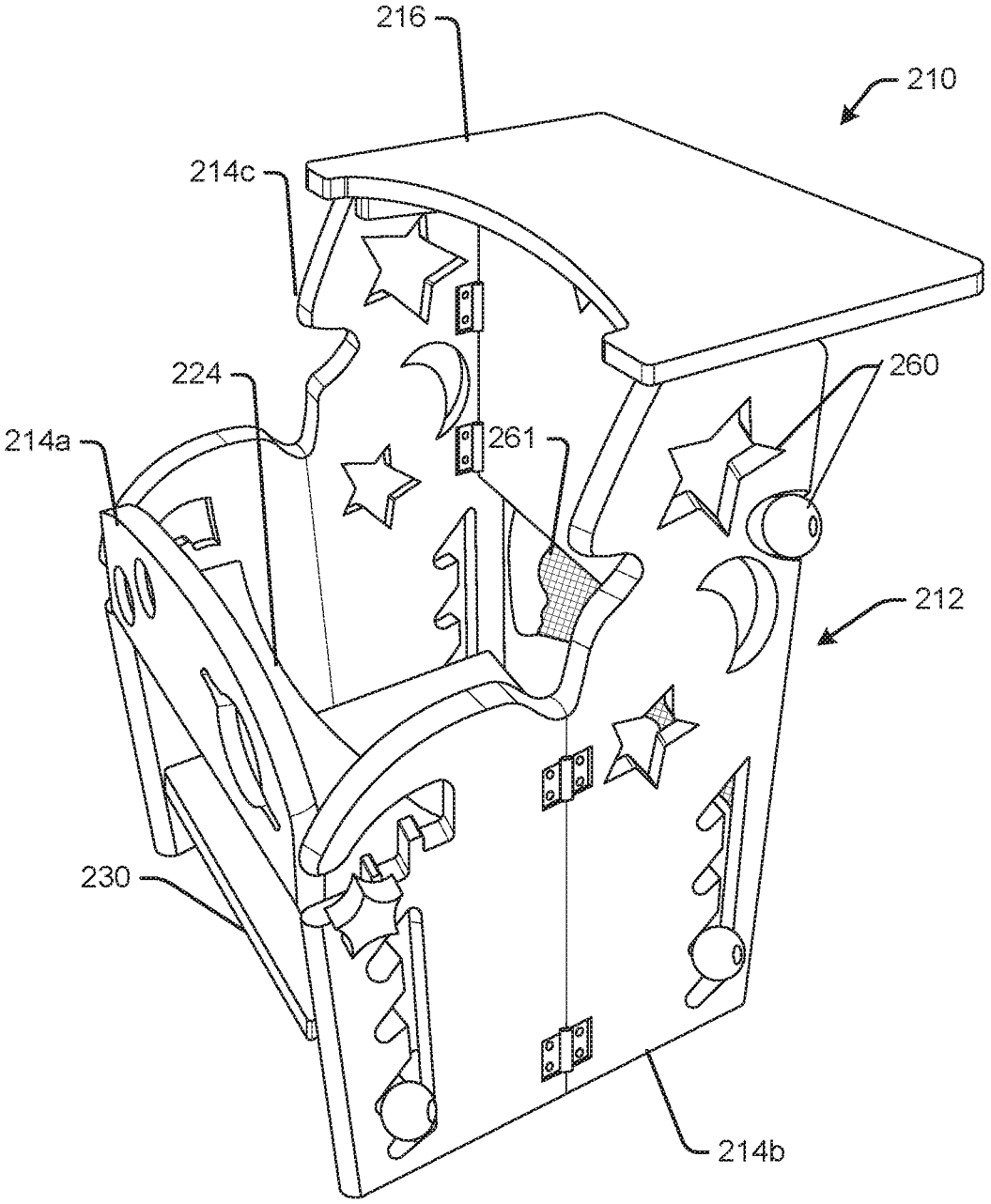
FIGS. 9A and 9B are perspective views of another example enclosed seating assembly.
Figure 9B:
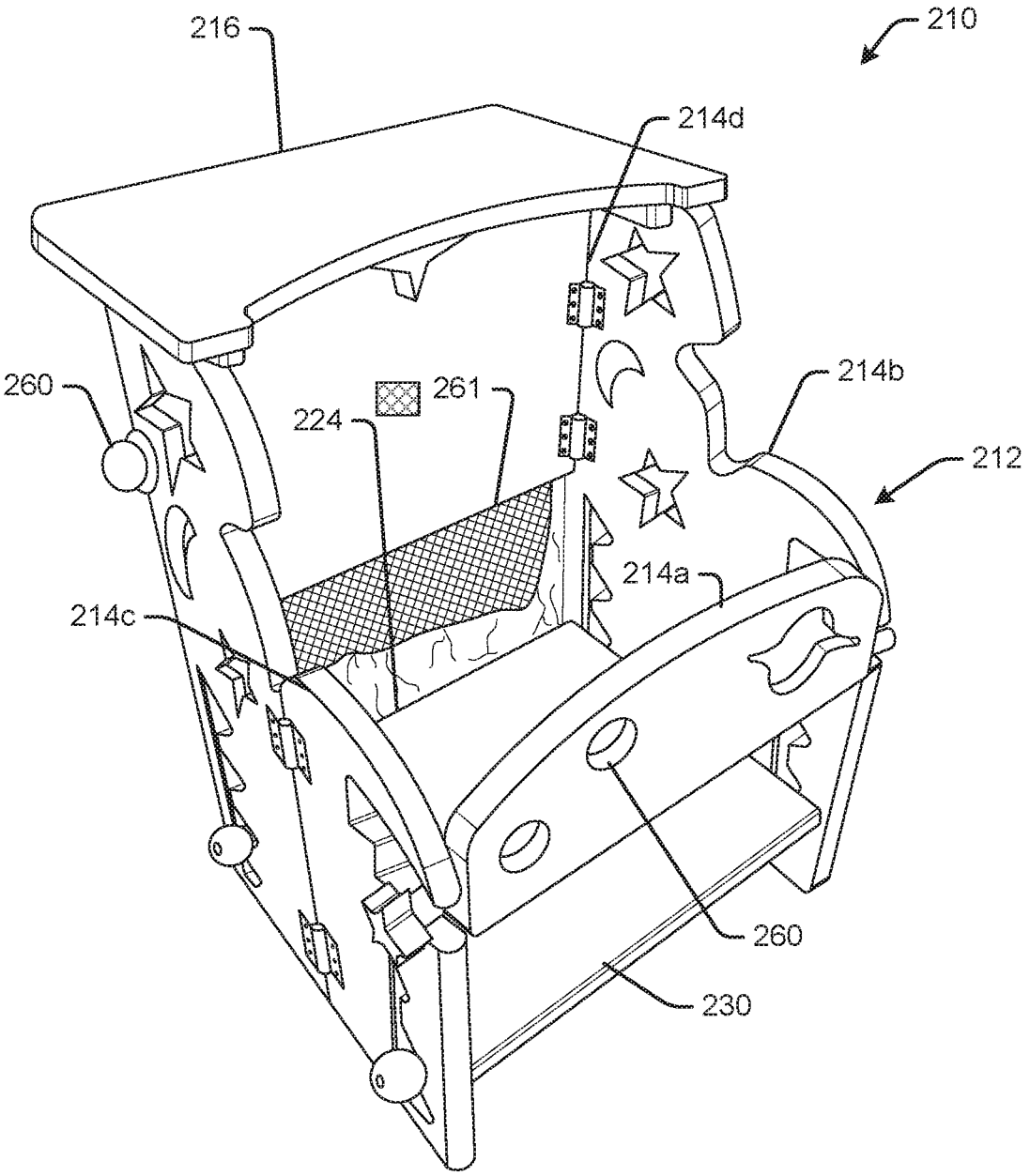

FIGS. 9A and 9B are perspective views of another example enclosed seating assembly 210. It is noted that like reference numbers in the 200-series are used herein to refer to like components. The description of like components is not described again for this example.

An example of the enclosed seating assembly 210 includes a chair enclosure 212 having sidewalls 214*a-d*. The chair enclosure 212 and related components (e.g., seat, table, legs, sensory modules, etc.) may be of any desired color scheme.

In this example, a child may be lifted into and out of the chair enclosure 212 to facilitate entry and exit from the chair enclosure 212, or the back panel 214*a* can be removed by untwisting the knobs to allow the child to step in. The back panel 214*a* may then be replaced. Both the spherical and star-shaped knobs twist off to allow adjustment.

In an example, the edge of the sidewall 214*a* may also include a perch seat 216. In another example, the enclosed seating assembly 210 may include an integrated perch seat that can be mounted to one or more of the sidewalls 214*a-d*. In another example, the enclosed seating assembly 210 may include no seat.

The example enclosed seating assembly 210 also includes at least one foot platform 230 at the base of the chair enclosure 212. The foot platform 230 raises the user off of the ground and provides a contained space within the chair enclosure 212.

The example enclosed seating assembly 210 may be provided with at least one sensory module 260 to provide varied input for the user. "Sensory modules" are tangible items that are configured to provide the user with various tactical input or feedback for the user. By way of illustration, the sensory module 260 may include a patterned floor to include on the foot platform 230. The pattern may be provided as part of the foot platform 230, or provided on top of the foot platform 230. Other sensory modules may be provided, and may be stored, for example in a mesh bag 261 which hangs from one or more of the side walls 214*a-d*.

Figure 10:
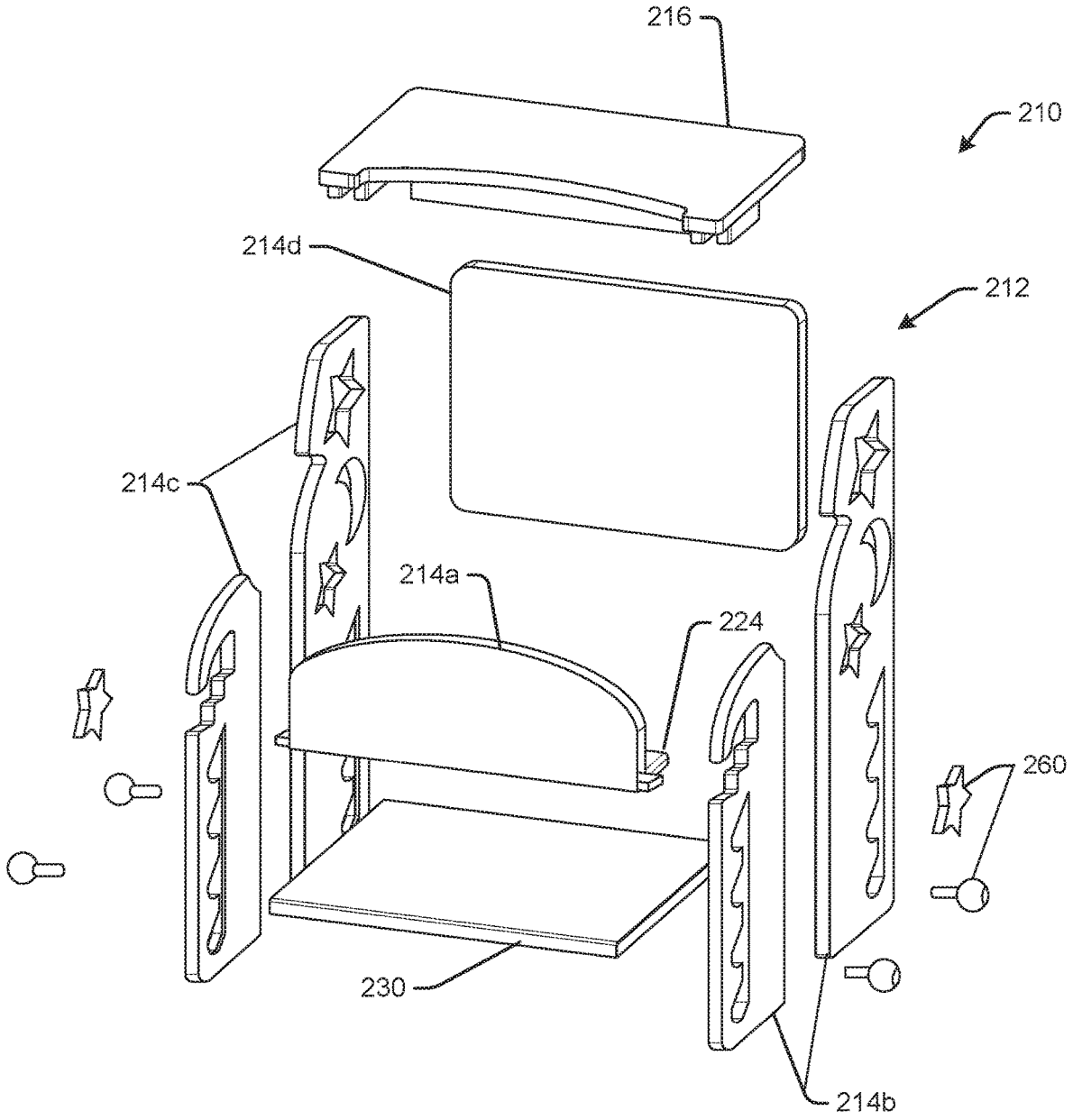
FIG. 10 is an exploded component view of the example enclosed seating assembly shown in FIGS. 9A and 9B.

The enclosed seating assembly 210 is collapsible and foldable for convenient storage and/or shipping. FIG. 10 is an exploded view illustrating example assembly/disassembly (e.g., for stowage) of the example enclosed seating assembly 210 shown in FIGS. 9A and 9B. In an example, the enclosure 212 is detached from the foot platform 230. The sidewalls 214*a-d* and other components (e.g., the perch seat 216) are unassembled and each component can be stacked. The process can be reversed for readily assembling the enclosed seating assembly 210.

In an example, the enclosed seating assembly may include a removable foot pad. The foot pad may be of various shapes, textures, and materials which assist helping some individuals by increasing sensory input to that individual.

In an example, the enclosed seating assembly may include a stabilizing base. The stabilizing base may be circular, completely circular, partially circular. The stabilizing base may be any shape which extends at least one point of the contours of a squarish chair enclosure assembly. In an example, the diameter or length of the base is greater than the average diameter, length, or width of the chair enclosure assembly.

In an example, the enclosed seating assembly may include anti-skid pad(s). The anti-skid pads may be removable. Any number of at least one anti-skid pad may be attachably removed to the bottom surface of the base.

In an example, the enclosed seating assembly may include a second step installed and a sensory pad on top of the second foot platform.

In an example, the enclosed seating assembly may include a netting coupled to the wall that faces the user. A foot pad is stored within each netting. A slot member may define a slot or a hook of a hook support that may be coupled to a shelf seat. By coupling a first hook support of a shelf seat through slot member as well as a second hook support through another slot member, a user may then raise the vertical distance of the shelf seat. A user may then use additional slot members to move the shelf seat to a middle location or a user may then use other slot members to position the shelf seat in the lowest position. A single position is associated with two slot members so that a shelf seat may be coupled to the wall at a certain vertical height that corresponds with the vertical height of the two slot members.

In an example, the enclosed seating assembly may include a sensory item such as a gel cooling pad that has ridges. A sensory item that may be used as a standing surface may have a felt or other type of outer cover and may have beads disposed in the interior. A sensory band may be used as a seat on which a user may sit, stand, or kneel. The stretch band may have a stretchable band, such as a rubber or cloth band that is coupled on either end to a holder, such as a dowel or stick.

A holder may be fed into a slot for the holder that is positioned in one of the walls of the chair enclosure assembly. The other holder may be disposed within a slot for the holder that is positioned in one of the opposing walls, thereby creating a seat or foot rest for a user. The user may sit on the stretchable band. The walls may have a feature for securing the holder once a holder has been disposed through the slot. Alternatively, after the holder has been disposed through a holder slot, the holder may then be rotated, such as by substantially 90 degrees, thereby allowing the holder to press against a wall when a user sits or stands on the stretchable band that is coupled to the holder.

In an example, the enclosed seating assembly may include an enclosure that feeds through two slots in the side of the unit. In an example, a heavy duty resistance band may be fed through slots cut into two opposite sides of the unit. The band hangs down so that the person using the station can stand on it or sit on it. The stretchable band may be height adjustable. Various slots for holders may be disposed within the walls.

The height of the example enclosed seating assembly may vary between 1 inch to 1000 inches. In an example, the height is between 15 inches and 40 inches, with a preferred height being 29 inches tall when the chair enclosure assembly is coupled to the base. In an example, the base may be substantially 1 inch tall. In an example, the height of the base ranges between 0.25 inches and 10 inches. Any dimensions which are given are non limiting examples only. Even if not specified, the dimensions could be decreased or increased.

In an example, the dimensions are between 80% and 150% of the dimensions which are listed as exemplary. Front and back panels may be 16" wide. These panels may be made from ½" pressed board, and may have a ½"×½" inner lip. Side panels may be 17" wide, and may be made from ½" pressed board with a ½"×½" inner lip. The base may have a 25" diameter and may be made from ¾" pressed board.

In an example, the rubber foot or feet, also known as an anti-skid pad(s) may be ¼" in in diameter. The shelf seat, first foot platform, or second foot platform may be 4 inches deep and may be made from pressed board and may have rounded corners. The shelf seat, first foot platform, or second foot platform may be 15⅞"×16⅞", may be made from ¾-inch pressed board, and may be grooved. Each wall may have holes for which fasteners, holders, or supports may be fastened so that the second foot platform or shelf seat may be adjustable in height. The shelf seat, first foot platform, or second foot platform 220 may have keyhole attachments, and there may be a plurality of sets of keyhole attachments. In an example, the dimensions are increased to allow for a larger or taller child. In an example, an additional sensory pack is included or utilized.

It is noted that the examples shown and described are provided for purposes of illustration and are not intended to be limiting. Still other examples are also contemplated.

The invention claimed is:

1. An enclosed seating assembly, comprising:

a chair enclosure;

a perch seat of the chair enclosure for a user to rest against but not fully sit on;

at least one foot platform at a base of the chair enclosure;

at least one sensory module to provide varied input for the user;

a stable base to reduce or altogether prevent tipping; and a door on a sidewall of the chair enclosure for the user to enter and exit the chair enclosure.

2. The enclosed seating assembly of claim 1, wherein the chair enclosure is foldable.

3. The enclosed seating assembly of claim 1, further comprising built in storage for the at least one sensory module.

4. The enclosed seating assembly of claim 1, wherein the at least one foot platform is height adjustable.

5. The enclosed seating assembly of claim 1, wherein the perch seat is height adjustable.

6. The enclosed seating assembly of claim 1, further comprising a detachable tray.

7. The enclosed seating assembly of claim 1, further comprising a ramp formed from a sidewall of the chair enclosure, the ramp for the user to enter and exit the chair enclosure.

8. The enclosed seating assembly of claim 1, wherein the ramp includes the at least one sensory module.

9. An enclosed seating assembly, comprising:

a foldable chair enclosure having at least four sidewalls;

a perch seat for a user to rest against but not fully sit on in the chair enclosure, the perch seat removable from the chair enclosure;

at least one foot platform at a base of the chair enclosure;

at least one sensory module to provide varied input for the user; and a stable base to reduce or altogether prevent tipping.

10. The enclosed seating assembly of claim 9, further comprising built in storage for the at least one sensory module.

11. The enclosed seating assembly of claim 9, wherein the at least one foot platform is height adjustable.

12. The enclosed seating assembly of claim 9, wherein the perch seat is height adjustable.

13. The enclosed seating assembly of claim 9, further comprising a detachable tray.

14. The enclosed seating assembly of claim 9, further comprising a door on a sidewall of the chair enclosure for the user to enter and exit the chair enclosure.

15. The enclosed seating assembly of claim 9, further comprising a ramp formed from a sidewall of the chair enclosure, the ramp for the user to enter and exit the chair enclosure.

16. The enclosed seating assembly of claim 9, wherein the ramp includes the at least one sensory module.

17. An enclosed seating assembly, comprising:

a foldable chair enclosure having at least four sidewalls;

an adjustable height perch seat for a user to rest against but not fully sit on in the foldable chair enclosure, the perch seat removable from the foldable chair enclosure;

at least one adjustable height foot platform at a base of the foldable chair enclosure;

at least one sensory module to provide varied input for the user;

an anti-tip structure on the base of the foldable chair enclosure configured to reduce or altogether prevent tipping; and built in storage for the at least one sensory module.

18. The enclosed seating assembly of claim 9, further comprising:

a detachable tray; and a door on a sidewall of the chair enclosure for the user to enter and exit the chair enclosure.

19. The enclosed seating assembly of claim 9, further comprising a ramp formed from a sidewall of the chair enclosure, the ramp for the user to enter and exit the chair enclosure, wherein the ramp includes the at least one sensory module.

20. The enclosed seating assembly of claim 1, wherein the door is one of a swing-out door, a ramp, and a removable panel.

* * * * *